US009556601B2

(12) United States Patent
Huang et al.

(10) Patent No.: US 9,556,601 B2
(45) Date of Patent: Jan. 31, 2017

(54) BASE CONNECTION DEVICE USED TO CHANGE A FLAPPER DRAIN VALVE TO A BARREL DRAIN VALVE

(71) Applicant: Feiyu Li, Xiamen (CN)

(72) Inventors: Baojia Huang, Xiamen (CN); Yuzhi Liu, Xiamen (CN); Jianfu Wu, Xiamen (CN)

(73) Assignee: WDI (XIAMEN) TECHNOLOGY INC., Xiamen (CN)

( * ) Notice: Subject to any disclaimer, the term of this patent is extended or adjusted under 35 U.S.C. 154(b) by 283 days.

(21) Appl. No.: 14/337,585

(22) Filed: Jul. 22, 2014

(65) Prior Publication Data

US 2015/0059869 A1 Mar. 5, 2015

(30) Foreign Application Priority Data

Aug. 28, 2013 (CN) ..... 2013 2 0529840 U

(51) Int. Cl.
*E03D 1/34* (2006.01)
*E03D 5/094* (2006.01)

(52) U.S. Cl.
CPC ..... *E03D 1/34* (2013.01); *E03D 5/094* (2013.01); *Y10T 137/5109* (2015.04)

(58) Field of Classification Search
CPC ..... E03D 1/304–1/306; E03D 1/33–1/35; E03D 2201/20; E03D 5/094
USPC ..... 137/269, 315.08; 4/324, 325, 378, 393, 4/398, 399
See application file for complete search history.

(56) References Cited

U.S. PATENT DOCUMENTS 8,365,320 B1 * 2/2013 Lordahl ..... E03D 1/34 4/378
2010/0218308 A1 * 9/2010 Schuster ..... E03D 1/14 4/325
2012/0261003 A1 * 10/2012 Stout ..... E03D 1/34 137/315.01
2012/0266374 A1 * 10/2012 Liu ..... E03D 1/34 4/324

* cited by examiner

*Primary Examiner* — Paul R Durand
*Assistant Examiner* — Nicholas Ros
(74) *Attorney, Agent, or Firm* — Rabin & Berdo, P.C.

(57) ABSTRACT

A base connection device used to change a flapper drain valve to a barrel drain valve includes a flapper base and a first overflow pipe disposed in the external side of the flapper base; further includes a connection base and a second overflow pipe, the bottom of the connection base is sleeved on the flapper base in sealing way, and closing the bottom of the first overflow pipe, the top of the connection base is formed to a matching portion; the bottom of the second overflow pipe is connected to the outlet of the flapper base. To change a flapper drain valve to a barrel drain valve, the flapper base does not need to be disassembled. The barrel drain valve is inserted to the connection base to sleeve the connection base on the flapper base, with the second overflow pipe as an overflow pipe of the water tank.

14 Claims, 7 Drawing Sheets

BASE CONNECTION DEVICE USED TO CHANGE A FLAPPER DRAIN VALVE TO A BARREL DRAIN VALVE

FIELD OF THE INVENTION

The present invention relates to a connection device, especially to a base connection device used to change a flapper drain valve to a barrel drain valve.

BACKGROUND OF THE INVENTION

Traditional toilet water tank is applied with flapper type drain valve, as a flapper drain valve has problems of large discharge volume and bad sealing resulting in waste of water resource, the flapper drain valves are used less and less. In idea of low carbon and environmental protection, more users change the traditional flapper drain valve to barrel drain valve. however, as the discharge port of the base of a barrel drain valve is not coupled to that of a flapper drain valve, it needs to disassemble the flapper base to change a flapper drain valve to a barrel drain valve, resulting in long-running and laborious to disassemble the flapper base, and it is inconvenient for users to change by themselves.

SUMMARY OF THE INVENTION

The object of the present invention is to overcome the disadvantages of the existing technology and to provide with a base connection device used to change a flapper drain valve to a barrel drain valve.

The technical proposal of the present invention to solve the technical problems is as below:

A base connection device used to change a flapper drain valve to a barrel drain valve, comprising a flapper base and a first overflow pipe disposed in the external side of the flapper base; further comprising a connection base and a second overflow pipe, the bottom of the connection base is sleeved on the flapper base in sealing way, and closing the bottom of the first overflow pipe, the top of the connection base is formed to a matching portion to insert the barrel drain valve; the bottom of the second overflow pipe is connected to the outlet of the flapper base.

In another preferred embodiment, the second overflow pipe is disposed in the external side of the top of the connection base.

In another preferred embodiment, the second overflow pipe is disposed inside the barrel drain valve, the bottom of the second overflow pipe is sleeved on a discharge gasket of the barrel drain valve in sealing way, the top of the second overflow pipe is linked with a wire rope used to open the barrel drain valve.

In another preferred embodiment, at least a V shaped sealing ring is sleeved on the exterior of the bottom of the connection base, the external periphery of the at least a V shaped sealing ring abuts against the internal side of the flapper base.

In another preferred embodiment, the second overflow pipe is fixed to the first overflow pipe by a nylon strip and/or a lock catch.

In another preferred embodiment, it further comprising a support frame, the support frame comprising two ferrules connecting together as one, one ferrule is sleeved on the first overflow pipe, and the second one is sleeved on the exterior of the top of the connection base.

In another preferred embodiment, the lock catch comprising a lock ring and an elastic clip with one side thereof connecting together as one, the bottom of the lock ring is disposed with a lower lock groove, the external side of the second overflow pipe is disposed with an upper lock groove, the lock ring is sleeved on the second overflow pipe, the lower lock groove of the lock ring is locked to the upper lock groove of the second overflow pipe; the elastic clip clamps the first overflow pipe flexibly and/or the elastic clip is fastened to the first overflow pipe by the nylon strip.

In another preferred embodiment, the bottom of the connection device is axial barrel structural, the top of the connection device is barrel structural with side wall hollowed-out.

In another preferred embodiment, the flapper base is an inclined flapper base.

In another preferred embodiment, the flapper base is a flat flapper base.

The advantages of the present invention are:

1. as with the connection base and the second overflow pipe, the bottom of the connection base is sleeved on the flapper base in sealing way, and closes the bottom of the first overflow pipe, the top of the connection base forms a cooperation portion to insert a barrel drain valve; the bottom of the second overflow pipe is connected to the discharge port of the flapper pipe, so that, to change a flapper drain valve to a barrel drain valve, it doesn't need to disassemble the flapper base, but to make the connection base of the present invention sleeved on the flapper base in sealing way, with the second overflow pipe as an overflow pipe of the water tank, the barrel drain valve is inserted to the connection base of the present invention, the operation is convenient and quick, it is convenient for users to change by themselves, thus benefit for assembly cost reduction.

2. with the V shaped sealing rings to seal the connection base and the flapper base, the external side of the V shaped sealing rings abuts the external side of the flapper base tightly under the work of water pressure, resulting in effective sealing; with the V shaped sealing rings, it is more convenient to assemble and in better sealing effect than other sealing components like O rings.

3. with the second overflow pipe, instead of the first overflow pipe, as a overflow pipe of the water tank, it solves a problem that if the bottom of the first overflow pipe is blocked by the connection base, the first overflow pipe can not work in overflow.

The present invention will be further described with the drawings and the embodiments; it is apparent that a base connection device used to change a flapper drain valve to a barrel drain valve is not limited to the embodiments.

DETAILED DESCRIPTION OF THE EMBODIMENTS

The First Embodiment

Figure 1:
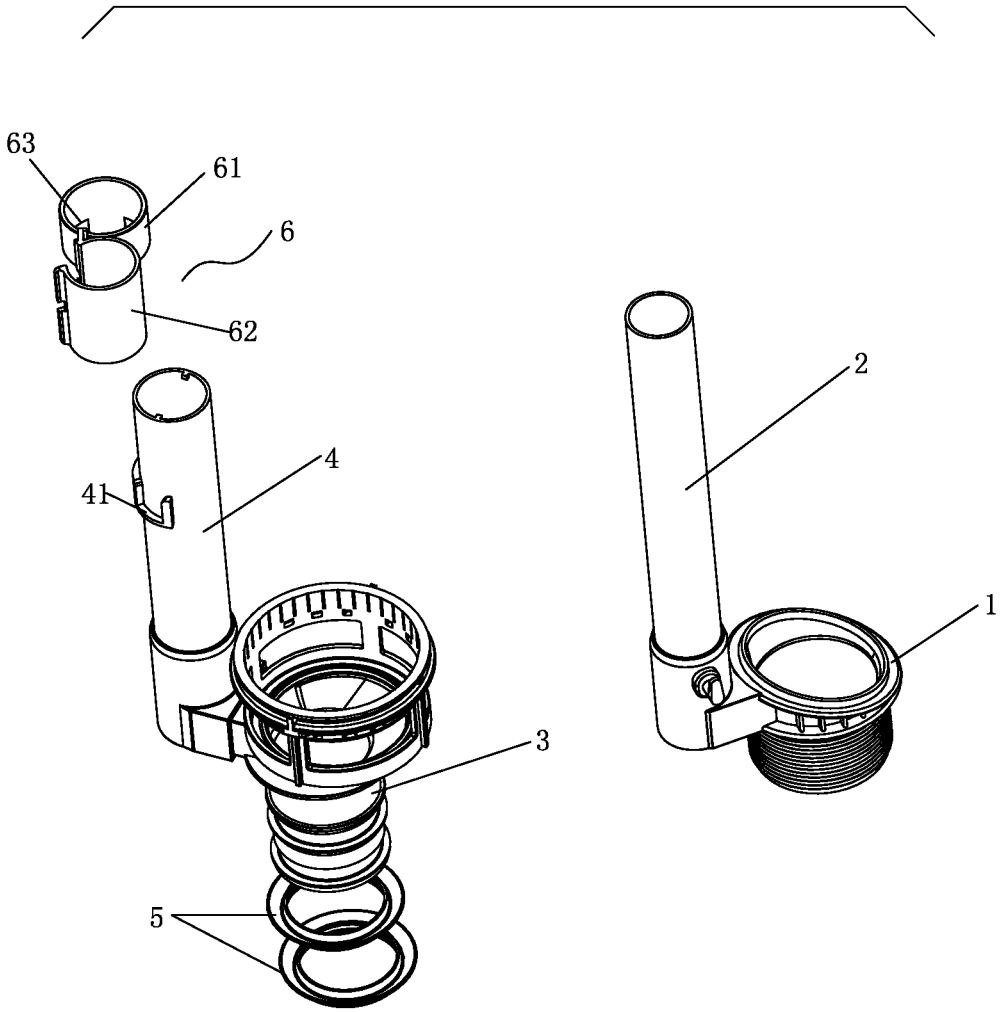
FIG. 1 illustrates an exploded diagram of a first embodiment of the present invention.

As figured in FIG. 1, a base connection device used to change a flapper drain valve to a barrel drain valve comprises a flapper base 1, a first overflow pipe 2 disposed in the external side of the flapper base 1, a connection base 3 and a second overflow pipe 4; the bottom of the connection base 3 is axial barrel structural, and is sleeved inside the flapper base 1 in sealing way, and closes the bottom of the first overflow pipe 2, the top of the connection base 3 is barrel structural with side wall hollowed-out, and it forms to a cooperation portion to insert with a barrel drain valve; the second overflow pipe 4 is disposed in the external side of the top of the connection base 3, the bottom thereof is connected to the interior of the connection base 3.

Preferred, the connection base 3 and the flapper base 1 are sealed with two V shaped sealing rings 5. more specifically, the two V shaped sealing rings 5 are sleeved on the external of the bottom of the connection base 3, the external peripheries of the V shaped sealing rings abut the internal side of the flapper base 1 under the work of water pressure, resulting in effective sealing.

Preferred, the second overflow pipe 4 is fixed to the first overflow pipe 2 by a nylon strip 7 and/or a lock catch 6. more specifically, the lock catch 6 comprises a lock ring 61 and an elastic clip 62 with one side thereof connecting together as one, the bottom of the lock ring 61 is disposed with a lower lock groove 63, the lock ring 61 is sleeved on the second overflow pipe 4, the lower lock groove 63 of the lock ring 61 is locked to the upper lock groove 41 of the second overflow pipe 4; the elastic clip clamps the first overflow pipe 2 flexibly, in another case, the elastic clip 62 is fastened to the first overflow pipe 2 by the nylon strip 7.

Figure 2:
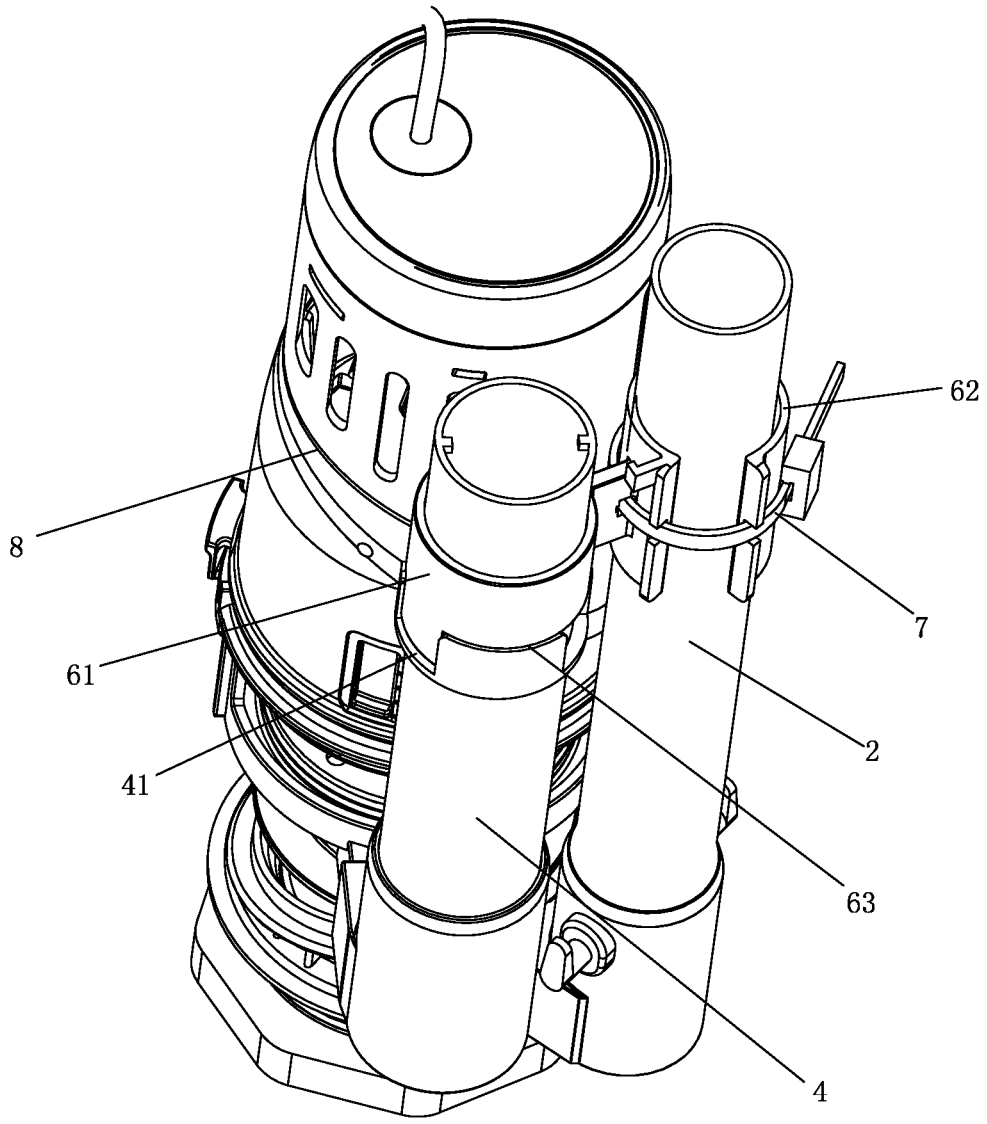
FIG. 2 illustrates a schematic diagram of the first embodiment of the present invention assembled with a barrel drain valve.
Figure 3:
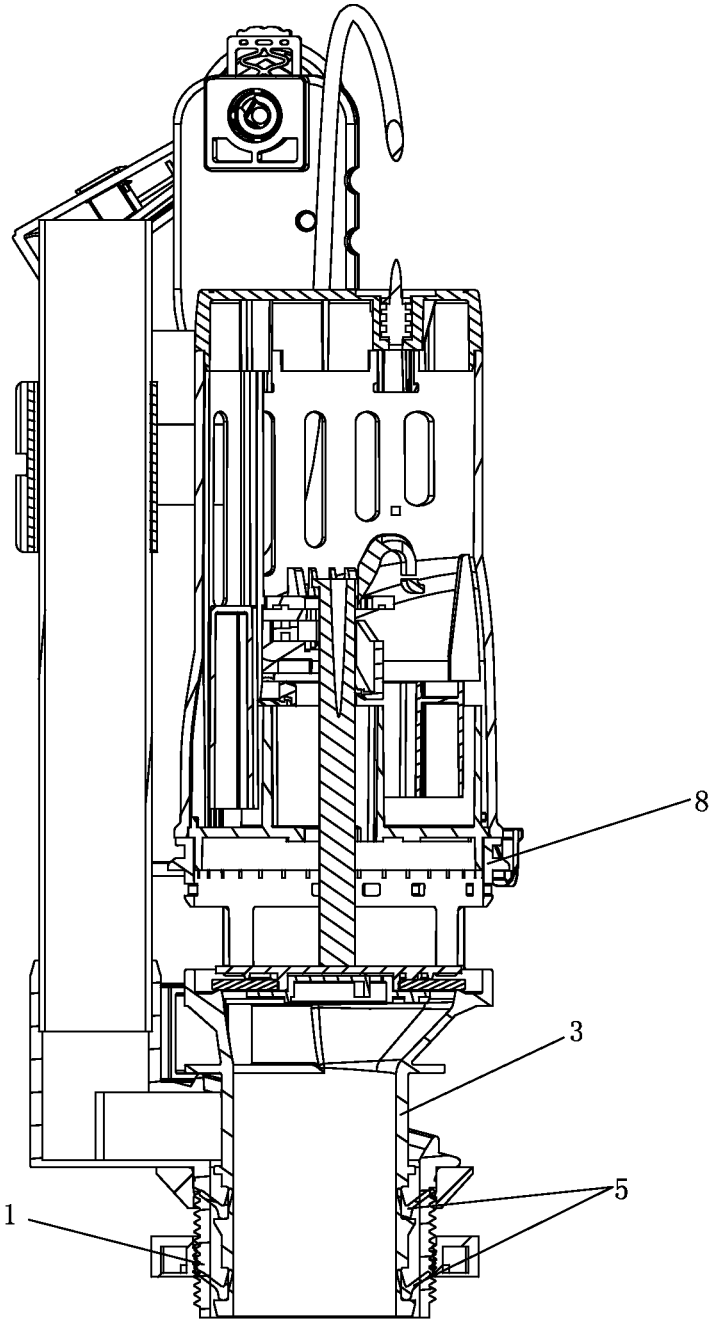
FIG. 3 illustrates a sectional view of the first embodiment of FIG. 2.

In the present invention of a base connection device used to change a flapper drain valve to a barrel drain valve, the flapper base 1 can be an inclined flapper base 1 or a flat flapper base 1. as figured in FIG. 2 and FIG. 3, to change a flapper drain valve to a barrel drain valve 8, disassembling the flapper drain valve, but leaving the flapper base 1, then making the two V shaped sealing rings 5 sleeved on the bottom of the connection base 3, before putting the connection base 3 into the flapper base 1; then putting the lock ring 61 of the lock catch 6 sleeved on the second overflow pipe 4, resulting in the lower lock groove 63 of the lock ring 61 locked to the upper lock groove 41 of the second overflow pipe 4, complementing positioning, then the elastic clip 62 of the lock catch 6 is sleeved on the first overflow pipe 2, in the next step, fastening the elastic clip 62 to the first overflow pipe 2 by the nylon strip 7; finally putting the barrel drain valve 8 to the top of the connection base 3 to complete a change of a flapper drain valve.

The Second Embodiment

Figure 4:
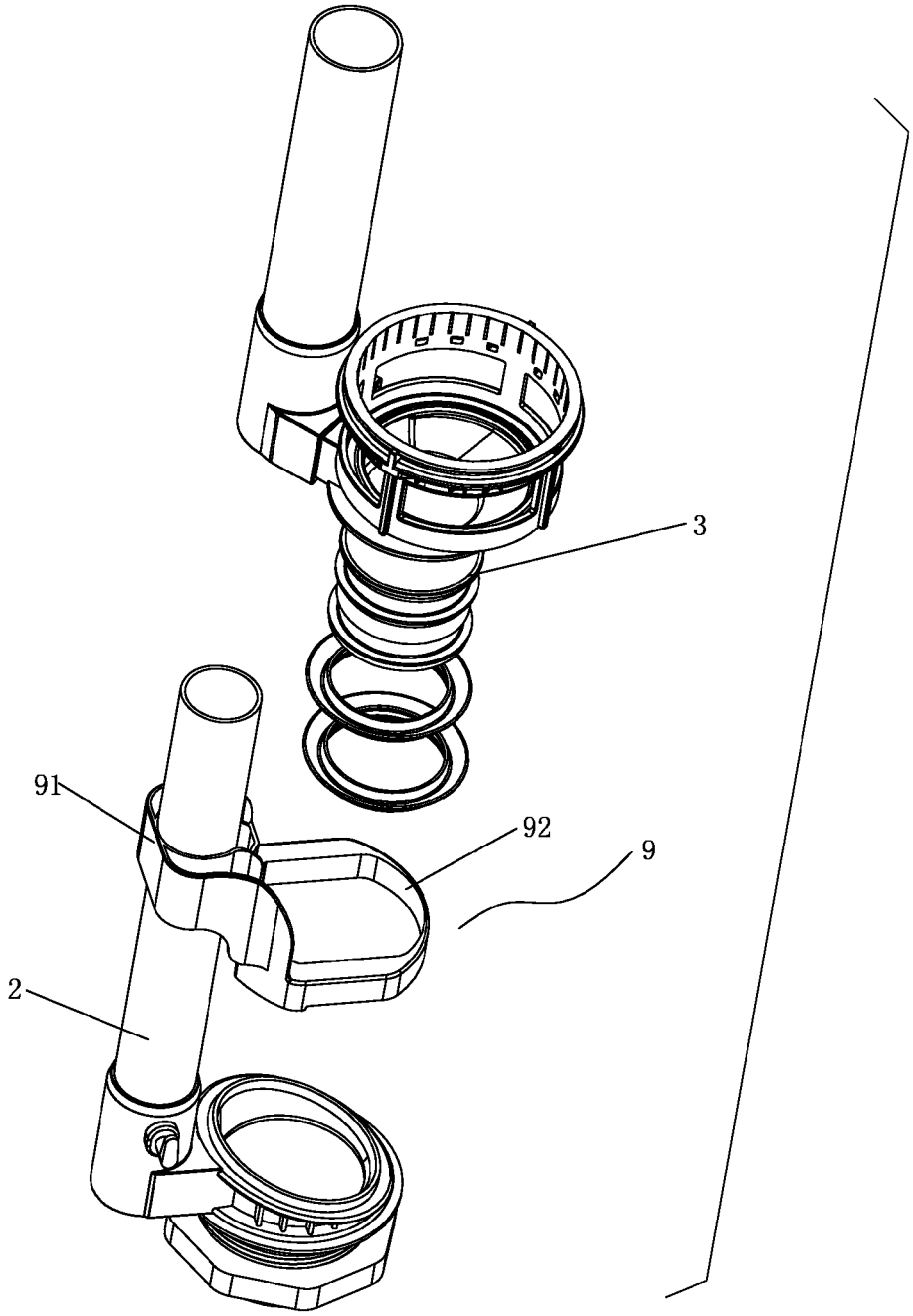
FIG. 4 illustrates an exploded diagram of a second embodiment of the present invention.
Figure 5:
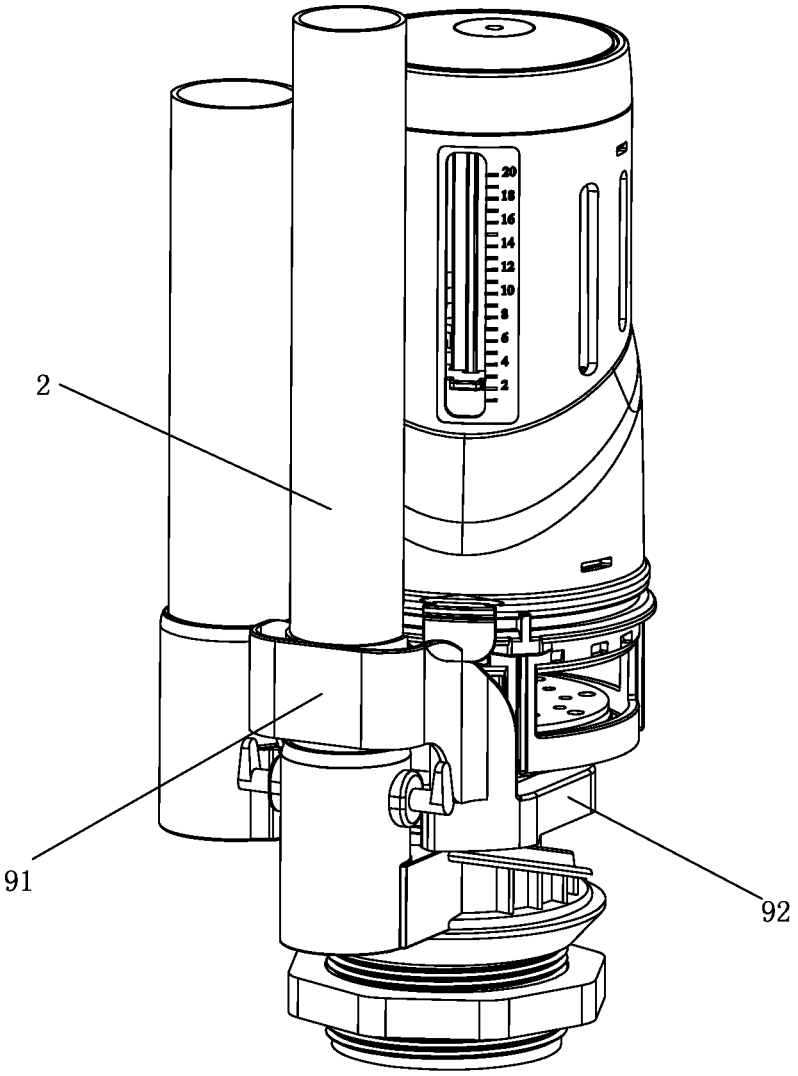
FIG. 5 illustrates a schematic diagram of the second embodiment of the present invention assembled with a barrel drain valve.

As figured in FIG. 4 and FIG. 5, the difference of this embodiment of the present invention from the first embodiment is that: the connection base 3 is not fixed by a lock catch 6 and/or a nylon strip but a support frame 9, more specifically, the support frame 9 comprises two ferrules 91, 92 of connecting together as one, one ferrule 91 is sleeved on the first overflow pipe 2, while the other ferrule 92 is sleeved on the external side of the top of the connection base 3.

The Third Embodiment

Figure 6:
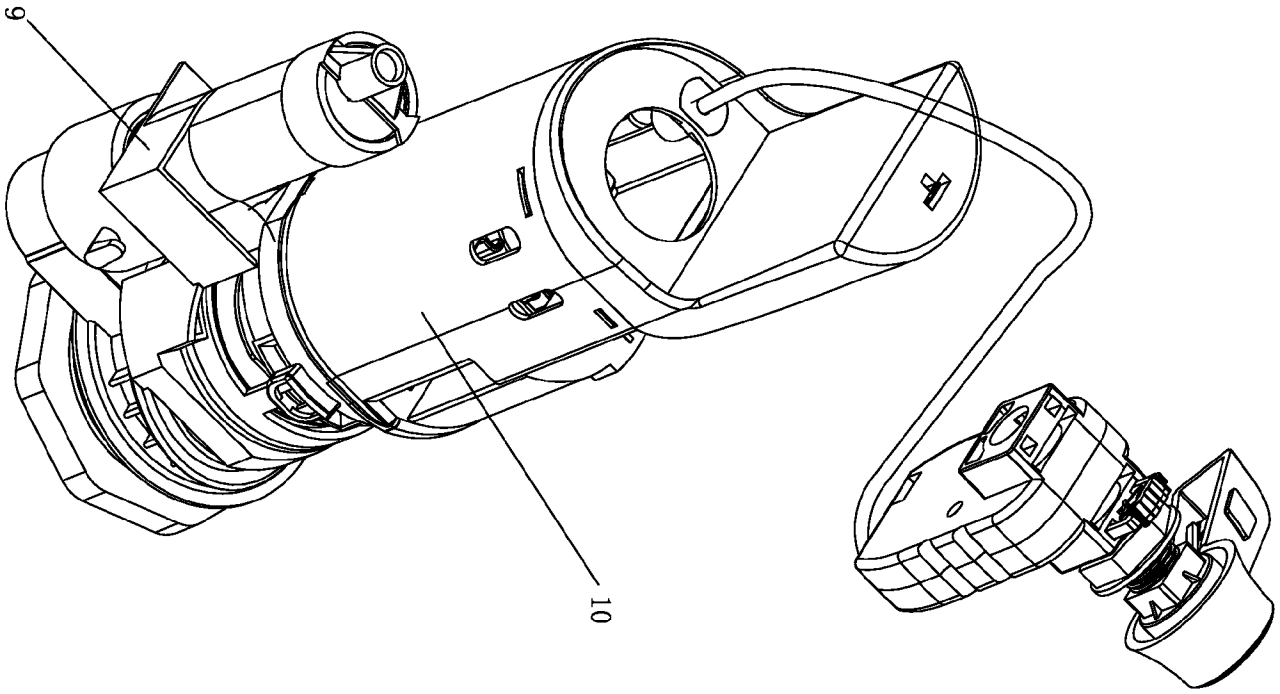
FIG. 6 illustrates a schematic diagram of a third embodiment of the present invention assembled with a barrel drain valve.
Figure 7:
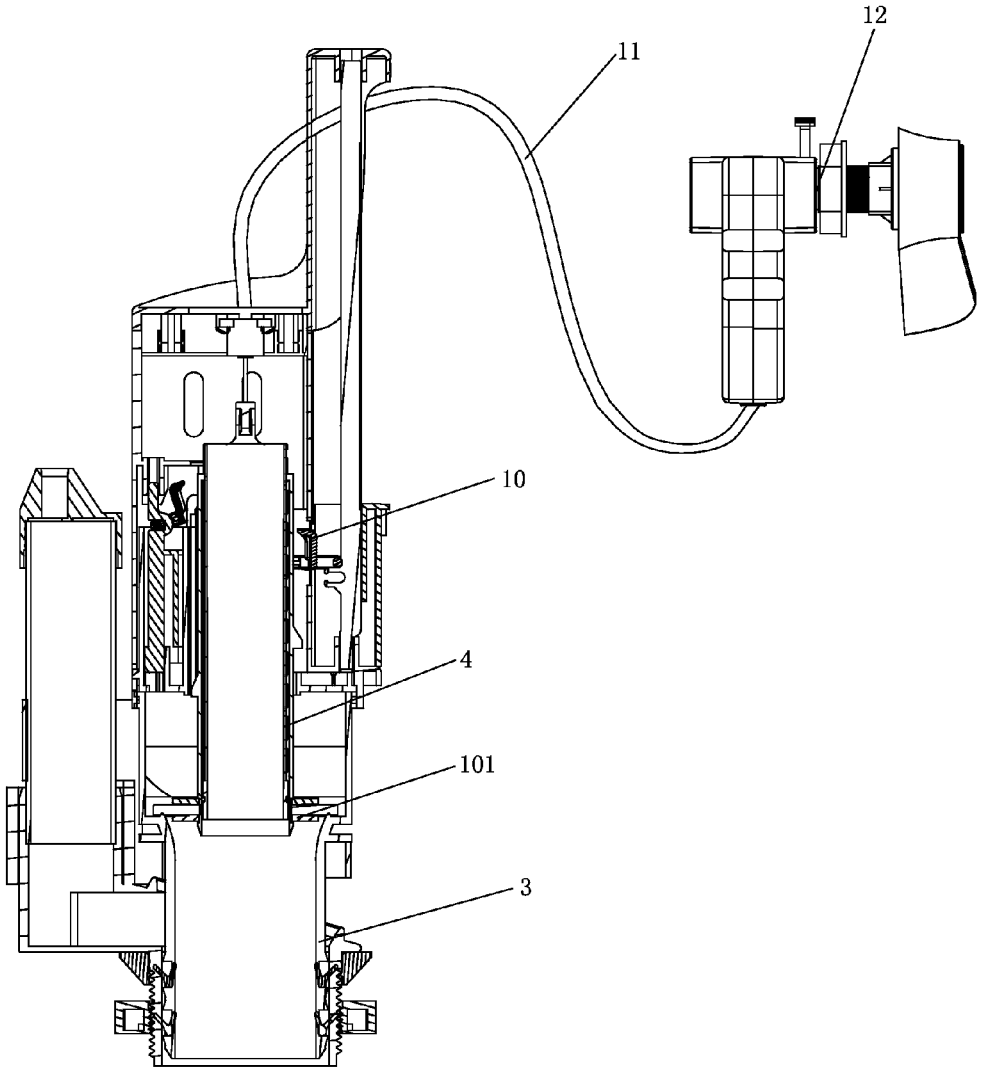
FIG. 7 illustrates a sectional view of the third embodiment of FIG. 6.

As figured in FIG. 6 and FIG. 7, the difference of this embodiment of the present invention from the second embodiment is that: the second overflow pipe 4 is not disposed in the external side of the top of the connection base but inside the barrel drain valve, and the bottom of the second overflow pipe 4 is sleeved on a discharge gasket 101 of the barrel drain valve, and the top of the second overflow pipe 4 is linked to a wire rope 11 used to open the barrel drain valve.

A base connection device used to change a flapper drain valve to a barrel drain valve of the present invention is applied with a support frame 9 to fix the connection base 3. with above structure, when the barrel drain valve 10 is switched on, the wire rope 11 connected to the switch 12 moves upwards and pulls the second overflow pipe 4 up, the second overflow pie 4 drives the discharge gasket 101 of the barrel drain valve to move upward to open the discharge port of the barrel drain valve 10, resulting in a discharge of the barrel drain valve. When the water level in the water tank exceeds the preset water level, the excess water flows to the second overflow pipe 4 from the top opening of the second overflow pipe 4, and then flows to the connection base 3 from the bottom opening of the second overflow pipe 4, finally flows to the toilet to the sewer.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A base connection device used to change a flapper drain valve to a barrel drain valve, comprising a flapper base and a first overflow pipe disposed in the external side of the flapper base; further comprising a connection base and a second overflow pipe, the bottom of the connection base is sleeved on the flapper base in sealing way, and closing the bottom of the first overflow pipe, the top of the connection base is formed to a matching portion to insert the barrel drain valve; the bottom of the second overflow pipe is connected to the outlet of the flapper base.

2. The base connection device used to change a flapper drain valve to a barrel drain valve according to any of claim 1, wherein at least a V shaped sealing ring is sleeved on the exterior of the bottom of the connection base, the external periphery of the at least a V shaped sealing ring abuts against the internal side of the flapper base.

3. The base connection device used to change a flapper drain valve to a barrel drain valve according to any of claim 1, further comprising a support frame, the support frame comprising two ferrules connecting together as one, one ferrule is sleeved on the first overflow pipe, and the second one is sleeved on the exterior of the top of the connection base.

4. The base connection device used to change a flapper drain valve to a barrel drain valve according to claim 1, wherein the bottom of the connection device is axial barrel structural, the top of the connection device is barrel structural with side wall hollowed-out.

5. The base connection device used to change a flapper drain valve to a barrel drain valve according to claim 1, wherein the flapper base is an inclined flapper base.

6. The base connection device used to change a flapper drain valve to a barrel drain valve according to claim 1, wherein the flapper base is a flat flapper base.

7. The base connection device used to change a flapper drain valve to a barrel drain valve according to claim 1, wherein the second overflow pipe is disposed in the external side of the top of the connection base.

8. The base connection device used to change a flapper drain valve to a barrel drain valve according to any of claim 7, wherein at least a V shaped sealing ring is sleeved on the exterior of the bottom of the connection base, the external periphery of the at least a V shaped sealing ring abuts against the internal side of the flapper base.

9. The base connection device used to change a flapper drain valve to a barrel drain valve according to any of claim 7, further comprising a support frame, the support frame comprising two ferrules connecting together as one, one ferrule is sleeved on the first overflow pipe, and the second one is sleeved on the exterior of the top of the connection base.

10. The base connection device used to change a flapper drain valve to a barrel drain valve according to claim 7, wherein the second overflow pipe is fixed to the first overflow pipe by a nylon strip and/or a lock catch.

11. The base connection device used to change a flapper drain valve to a barrel drain valve according to claim 10, wherein the lock catch comprising a lock ring and an elastic clip with one side thereof connecting together as one, the bottom of the lock ring is disposed with a lower lock groove, the external side of the second overflow pipe is disposed with an upper lock groove, the lock ring is sleeved on the second overflow pipe, the lower lock groove of the lock ring is locked to the upper lock groove of the second overflow pipe; the elastic clip clamps the first overflow pipe flexibly and/or the elastic clip is fastened to the first overflow pipe by the nylon strip.

12. The base connection device used to change a flapper drain valve to a barrel drain valve according to claim 7, wherein the second overflow pipe is disposed inside the barrel drain valve, the bottom of the second overflow pipe is sleeved on a discharge gasket of the barrel drain valve in sealing way, the top of the second overflow pipe is linked with a wire rope used to open the barrel drain valve.

13. The base connection device used to change a flapper drain valve to a barrel drain valve according to any of claim 12, wherein at least a V shaped sealing ring is sleeved on the exterior of the bottom of the connection base, the external periphery of the at least a V shaped sealing ring abuts against the internal side of the flapper base.

14. The base connection device used to change a flapper drain valve to a barrel drain valve according to any of claim 12, further comprising a support frame, the support frame comprising two ferrules connecting together as one, one ferrule is sleeved on the first overflow pipe, and the second one is sleeved on the exterior of the top of the connection base.

* * * * *